US006592119B2

(12) United States Patent
Goldbeck et al.

(10) Patent No.: US 6,592,119 B2
(45) Date of Patent: Jul. 15, 2003

(54) STACK HEIGHT DETERMINATION AND STACK HEIGHT CONTROL MECHANISM

(75) Inventors: Uwe Hermann Goldbeck, Kiel (DE); Dirk Dobrindt, Klausdorf/Schwentine (DE)

(73) Assignee: NexPress Solutions LLC, Chester, NY (US)

( * ) Notice: Subject to any disclaimer, the term of this patent is extended or adjusted under 35 U.S.C. 154(b) by 72 days.

(21) Appl. No.: 09/850,462

(22) Filed: May 7, 2001

(65) Prior Publication Data

US 2001/0054791 A1 Dec. 27, 2001

(30) Foreign Application Priority Data

May 15, 2000 (DE) ..... 100 23 807

(51) Int. Cl.[7] ..... B65H 1/18
(52) U.S. Cl. ..... 271/152; 271/154
(58) Field of Search ..... 271/152–156

(56) References Cited

U.S. PATENT DOCUMENTS 3,722,879 A * 3/1973 Johnston et al. ..... 271/176
5,347,350 A * 9/1994 Nakahata et al. ..... 271/153
5,518,230 A * 5/1996 Scarlata et al. ..... 271/155
5,556,252 A * 9/1996 Kuster ..... 271/155
6,165,113 A * 12/2000 Reider ..... 493/15
6,279,899 B1 * 8/2001 Coffey et al. ..... 270/58.02
6,299,156 B1 * 10/2001 Kaneda et al. ..... 271/117

FOREIGN PATENT DOCUMENTS

DE 18 12 018 12/1970
DE 23 10 639 9/1973
DE 41 01 436 A1 7/1992
DE 197 11 406 C1 10/1998

OTHER PUBLICATIONS

JP 10250897 A, In: Patent Abstracts of Japan, *Paper Treatment Device*, Sep. 22, 1998.

* cited by examiner

*Primary Examiner*—Christopher P. Ellis
*Assistant Examiner*—Mark A. Deuble
(74) *Attorney, Agent, or Firm*—Lawrence P. Kessler

(57) ABSTRACT

The invention concerns a stack height determination mechanism (25) for a stack (1) consisting of flat material (2) with at least one sensor (3) to determine stack height and a stack height control mechanism. Exact determination of the stack height, especially in order to exactly position the stack for the next delivery of material (2), is achieved in that a flat element (4) to determine the height of the stack (1) is brought into a bearing position (5) on the stack and that this bearing position (5) is determined by at least one sensor (3).

5 Claims, 2 Drawing Sheets

STACK HEIGHT DETERMINATION AND STACK HEIGHT CONTROL MECHANISM

FIELD OF THE INVENTION

The invention relates to a stack height determination mechanism for a stack consisting of flat material, preferably sheet paper, with at least one sensor to determine stack height and such a stack height control mechanism with such a stack height determination mechanism.

BACKGROUND OF THE INVENTION

A stack height determination mechanism is disclosed in U.S. Pat. No. 6,318,954, issued Nov. 20, 2001, in the name of Claassen et al., which proposes providing on the edge of the stack a row of sensors disposed above each other which determine stack height by recording to the extent to which light emitted from the stack is reflected or not. The disadvantage of this configuration exists in the fact that a material, paper in particular, which does not lie neatly or is wrinkled, will result in a malfunction indication. In addition, a crease or bulge in the measurement range is recorded as stack height, even if it does not exist in other areas or is still deposited after measurement. A stack cannot be exactly positioned in this manner, which is particularly disadvantageous if further material is to be delivered and the plane of conveyance is incorrect as a result of the inexact setting.

SUMMARY OF THE INVENTION

The object of the invention therefore is to construct a stack height determination mechanism in such a way that exact stack height determination is possible, especially in order to exactly position the stack for the next delivery of material.

The object is solved in accordance with the invention in that a flat element to determine the height of the stack is brought into a bearing position on the stack and that this bearing position is determined by at least one sensor.

The advantage of the invention consists in the fact that the height of the stack is exactly determined, independently of whether there are wrinkles or bulges in the material at the measurement location. At the same time, the height determined corresponds to the height of the delivered material occupied by the latter after complete delivery on the entire surface. Stack height determined in this manner provides a substantially more exact measurement, in particular for a height setting which is used to set the function-adjusted plane of conveyance for additional material to be delivered.

The height of the flat element, which represents a measurement for the height of the stack, can be determined in different ways. Approximation sensors, ultrasonic sensors, stop switches or other sensors are possible. As an advantageous refinement it is proposed that at least one sensor is an optical sensor. Moreover, it can be a single sensor whose function will be elucidated later, or it is possible to dispose a row of optical sensors in such a way that several height positions of the flat element can be determined by such row of optical sensors.

The flat element can be an element provided for this measurement purpose which is equipped with a drive mechanism and control device which moves the element into the measurement position and again removes same from the latter for delivery of additional material. As an expedient development, however, it is proposed that the flat element is a functional element of a delivery device for the flat material. This has the advantage that the separate provision of a flat element and its drive and control device can be dispensed with and, as a result, stack height determination substantially simplified. An expedient refinement provides that the flat element is the holding-down clamp of a delivery device. Because such holding-down clamp functions to position delivered material on the stack, exact height determination by it is assured. In particular, it determines stack height on the side at which additional material is being fed and, consequently, also determines the height which is controlling for the setting of the plane of conveyance.

One refinement for the disposition of a sensor on a holding-down clamp provides that at the back end of the stack the delivery device exhibit horizontally and vertically movable tongues, actuatable and horizontally movable rollers, and at least one horizontally and vertically movable holding-down clamp, in which case drive mechanisms and a control device so constructed are provided, that a flat material, lying between the rollers and tongues, is conveyed by the rollers into its delivery position, that the holding-down clamp then presses the flat material onto the stack, that this height position of the holding-down clamp is determined by at least one sensor and that subsequently the rollers are lifted and the tongues withdrawn from the stack counter to the direction of conveyance and that to convey additional material the holding-down clamp is lifted, withdrawn from the delivery area and that the tongues and rollers are again conveyed into the position for the delivery of additional material. In this manner, after every delivery of a material, stack height is determined and can, therefore, always be exactly set.

The invention further relates to a stack height control mechanism with a stack height determination device. According to a stack height control mechanism, a stack height adjustment device and a control mechanism are provided where stack height is determined after every delivery of material and by the control mechanism causes the stack height adjustment device to set the target height. A stack height control mechanism can be equipped with a stack height determination mechanism of all the aforementioned specific embodiments. The stack height adjustment control mechanism is, however, preferably constructed in such a way that after the flat element bears on the stack, the stack height adjustment device depresses the stack until a sensor responds, which sensor is disposed in such a manner that it determines target stack height attainment through the corresponding position of the holding-down clamp.

The invention, and its objects and advantages, will become more apparent in the detailed description of the preferred embodiment presented below.

BRIEF DESCRIPTION OF THE DRAWING

The invention is elucidated on the basis of the drawings. Shown are, in.

DETAILED DESCRIPTION OF THE INVENTION

Figure 1:
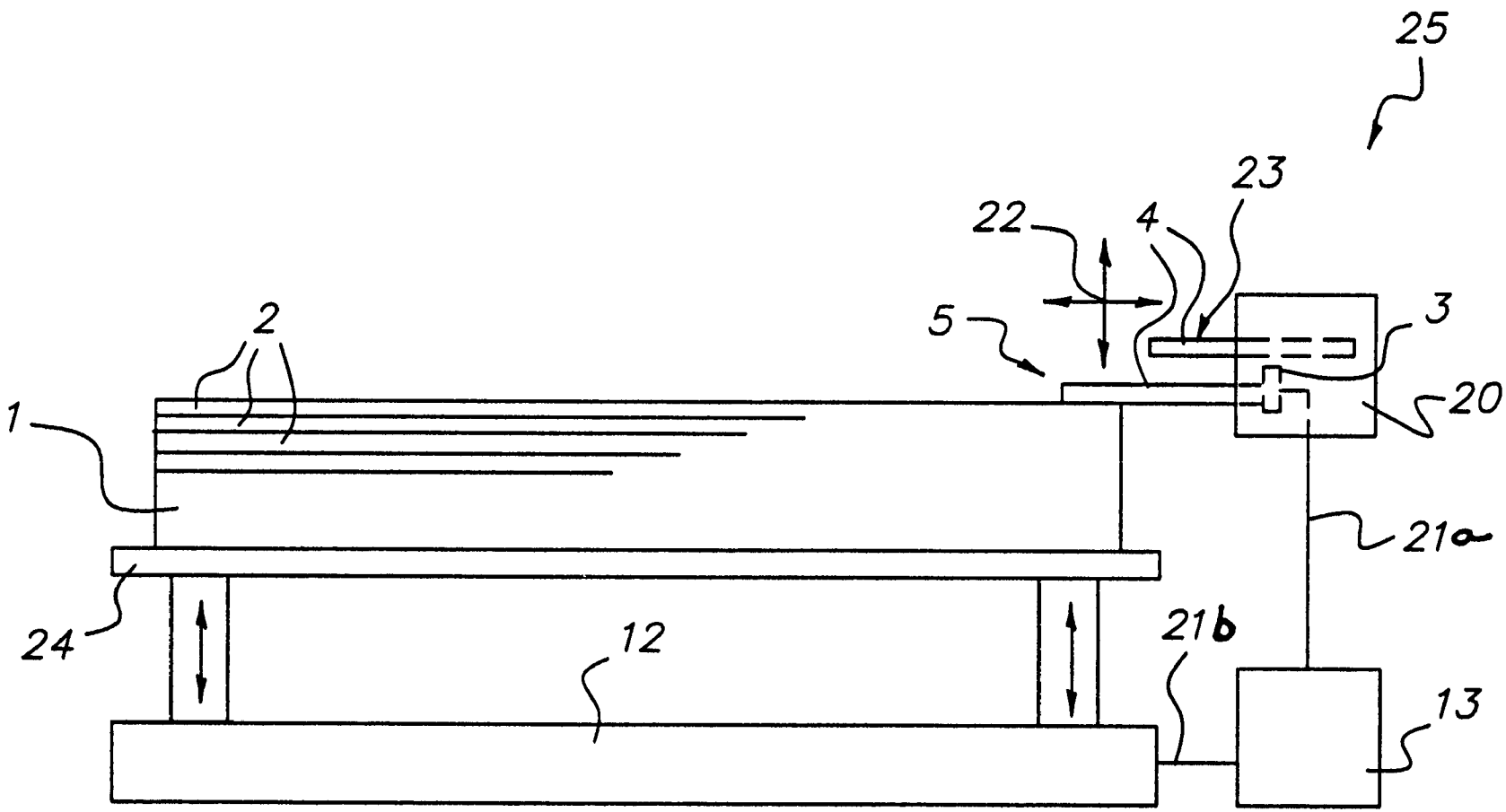
FIG. 1, an elementary drawing of a stack height control mechanism with a stack height determination mechanism.

FIG. 1 shows an elementary drawing of a stack height control mechanism with a stack height determination mechanism. The stack 1 is located on a delivery table 24 whose height can be positioned by a stack height adjustment device 12. A stack height determination mechanism 25 is provided for this purpose which exhibits a flat element 4 which, to determine the height of the stack 1, can be brought into a bearing position 5 in which it bears on the stack 1 and, therefore, supplies a measurement for the stack height that can be determined by a sensor 3. In order to bring the flat element 4 into the bearing position 5, or a resting position 23, a positioning device 20 is provided. The resting position 23 functions to enable additional material 2 to be deposited on the stack 1. The measurement of the sensor 3 is transmitted by a connection 21*a* to a control mechanism 13 which, via a further connection 21*b*, passes the adjustment commands onto the stack height adjustment device 12 so that the latter brings the surface of the stack 1 into its target position, for example, into the plane of conveyance.

Figure 2:
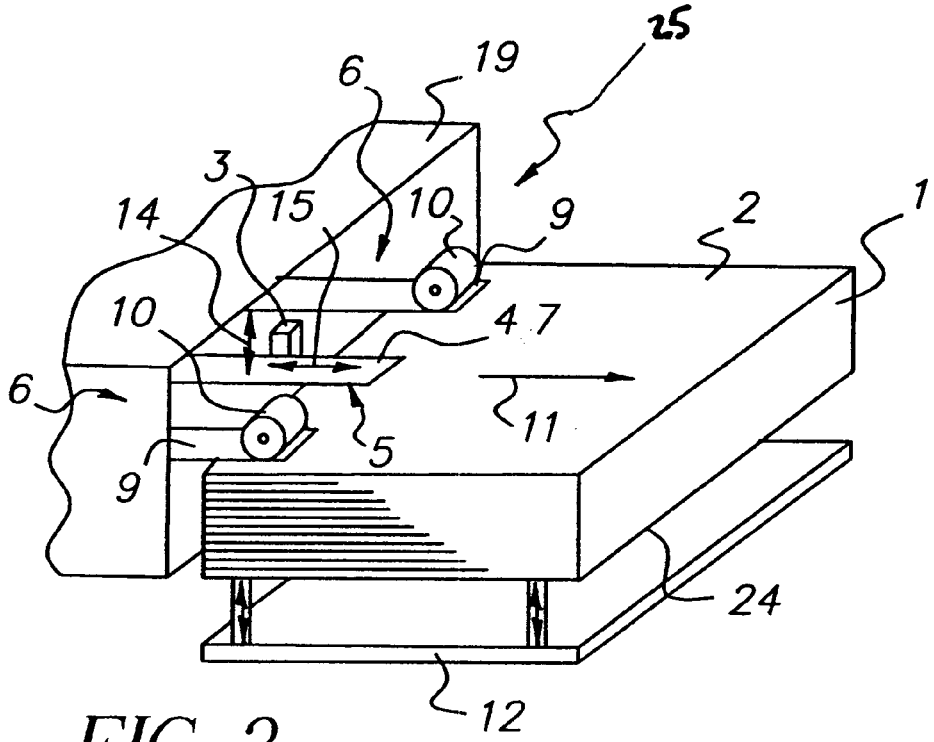
FIG. 2, a stack height control and determination device with delivery device in perspective view.
Figure 3:
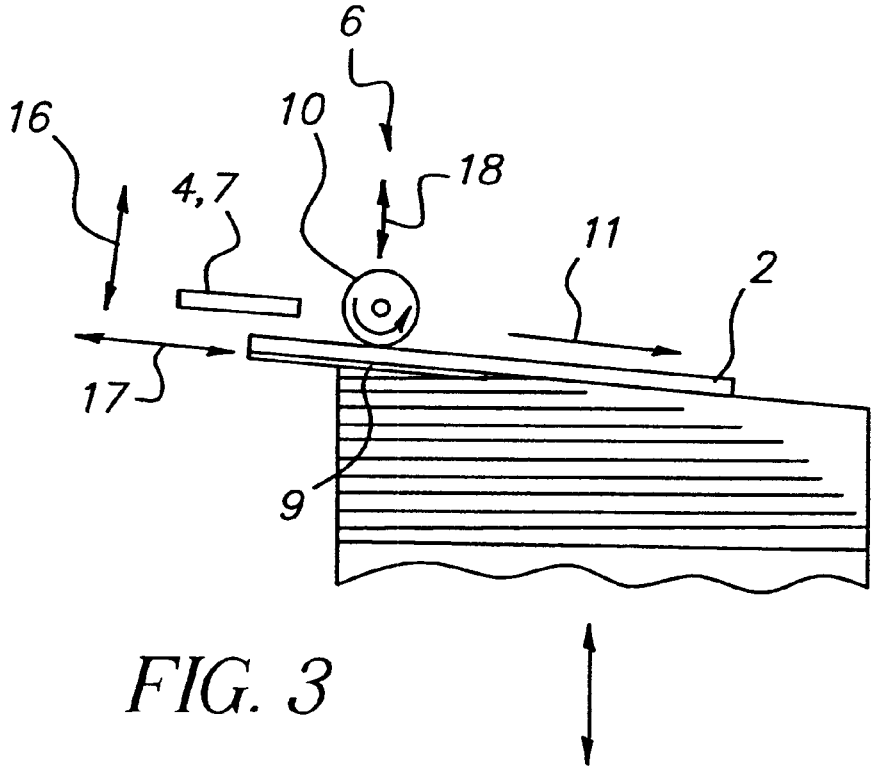
FIG. 3, a partial and side view of the stack height control and determination device with a delay device of FIG. 1.

FIGS. 2 and 3 show the stack height control and stack height determination mechanism 25 in accordance with the invention by a delivery device 6 (deliverer) of a printing press 19. With this delivery device 6, rollers 10 are used to convey the flat material 2. The rollers 10 are combined with tongues 9, in which case the rollers 10, with their high friction surface vis-à-vis the flat material 2, convey the flat material 2 through rotation until the defined delivery position 9 is attained and then brake at the correct moment. FIG. 3 shows such conveyance of a material 2. At the same time, the rollers 10 act together with the tongues 9 which exhibit little friction and are disposed in such a way that the flat material 2 slides on the tongues 9 and is conveyed by the rollers 10.

When a flat material 2 then reaches the defined delivery position, a holding-down clamp 7 is actuated by a horizontal and vertical movement 15 and 14 such that it holds the flat material 2 in the delivery position by pressing it onto the stack 1. The sensor 3 immediately determines this position 5 of the holding-down clamp 7 and transmits a signal to the control mechanism 13 which causes the stack height control mechanism 12 to adjust the target position of the stack 1.

Another possibility is that the stack height adjustment device 12 moves the stack 1 downward until the height differential to the target position—the stack 1 became higher through delivery of a material 2—has been equalized. In this case, the sensor 3 is adjusted in such a way that only upon reaching the target position does it respond and the dropping motion of the stack height control mechanism 12 ceases. This repeats itself after the next material 2 is deposited on the stack 1. To enable this, the rollers 10 drop through a vertical movement 18 and the tongues are withdrawn in the direction of the double arrow 17 counter to the direction of conveyance 11, as a result of which the back end of the flat material 2 deposits itself even in those areas in which the tongues 9 were.

For delivery of the next flat material 2, the tongues 9 are repositioned through a vertical movement 16 and a horizontal movement 17 into the position shown, above the previously delivered material 2, and the tongues 9 and rollers 10 drop in such a way that a flat material 2 can again be conveyed between the tongues 9 and the rollers 10 up to the delivery position. The vertical movement 14 and the horizontal movement 15 of the holding-down clamp 7 function as retraction mechanism so that new material 2 can be delivered.

These refinements of the stack height determination mechanism 25 and stack height control mechanism are obviously only illustrative. All kinds of flat elements 4 can be used to determine the height of the stack 1; for example, the tongues 9 could also fulfill this function.

The application field is also not limited to a printing press 19. It is possible to apply the invention to all fields in which flat material 2 is deposited on a stack 1 and in which stack height determination is necessary. A fundamental application field certainly exists whenever a plane of conveyance must be adjusted for a delivery device 6 so the next flat material 2 delivered neatly arrives on the stack 1.

The invention has been described in detail with particular reference to certain preferred embodiment thereof, but it will be understood that variations and modifications can be effected within the spirit and scope of the invention.

LIST OF REFERENCE SYMBOLS

1 stack
2 flat material
3 sensor
4 flat element
5 bearing position
6 delivery device
7 holding-down clamp
8 back end of stack
9 tongues
10 rollers
11 arrow: direction of conveyance
12 stack height adjustment device
13 control mechanism
14 double arrow: vertical movement of the holding-down clamp
15 double arrow: horizontal movement of the holding-down clamp
16 double arrow: vertical movement of the tongues
17 double arrow: horizontal movement of the tongues
18 double arrow: vertical movement of the rollers
19 printing press
20 adjustment device for a flat element
21 connections
22 adjustment movements of the flat element
23 resting position of the flat element
24 delivery table
25 stack height determination mechanism

What is claimed is:

1. A device for stacking flat material, including a delivery device for delivering flat material to a stack, and a stack height determination mechanism for a stack of flat material, comprising:

a flat element to determine the height of a stack of flat material, said flat element, movable horizontally and vertically, providing a functional element of said delivery device;

adjacent to one side of a stack, said delivery device including horizontally and vertically movable tongues, and actuatable and horizontally movable rollers; and drive mechanisms and a control device operative such that flat material, lying between said rollers and said tongues is conveyed in a direction into its delivery position to the stack, that said flat element is moved into a bearing position to press flat material onto the stack and the height position of said flat element is determine by at least one sensor, and that subsequently said rollers are lifted and said tongues are withdrawn from the stack (1) counter to the direction of flat material conveyance and that then, to convey additional flat material, flat element is lifted, withdrawn form the delivery area and said tongues and said rollers are again conveyed into the position for delivery of additional flat material.

2. The flat material stacking device and stack height determination mechanism according to claim 1, wherein said sensor is a row of optical sensors disposed in such a way that several height positions of said flat element can be determined by means thereof.

3. The flat material stacking device and stack height determination mechanism according to claim 1, wherein said functional element provided by said flat element is a holding-down clamp for flat material in said stack.

4. The flat material stacking device and stack height control mechanism according to claim 1, wherein said device mechanism and control device include a stack height adjustment device and a control mechanism where stack height is determined after delivery of flat material and said control mechanism causes said stack height adjustment device to set a target height.

5. The flat stacking device and stack height determination mechanism according to claim 4, wherein after said flat element bears on the stack, said stack height adjustment device depresses the stack (1) until said at least one sensor responds, which sensor is disposed in such a manner that it determines attainment of target height of the stack (1) through the corresponding position of said flat element.

* * * * *